US007334360B1

(12) United States Patent
Corry

(10) Patent No.: US 7,334,360 B1
(45) Date of Patent: Feb. 26, 2008

(54) SIMULATED INTENSE LOG STACK BURNING FIRE

(76) Inventor: Arthur Andrew Corry, 6832, Traiv Blvd., Naples, FL (US) 34108

( * ) Notice: Subject to any disclaimer, the term of this patent is extended or adjusted under 35 U.S.C. 154(b) by 0 days.

(21) Appl. No.: 11/633,158

(22) Filed: Dec. 4, 2006

(51) Int. Cl.
*G09F 19/00* (2006.01)

(52) U.S. Cl. ..... 40/428; 472/65

(58) Field of Classification Search ..... 40/428; 472/65; 362/806; 392/348
See application file for complete search history.

(56) References Cited

U.S. PATENT DOCUMENTS

| | | | | |
|---|---|---|---|---|
| 1,432,942 | A * | 10/1922 | Zei et al. | 40/428 |
| 4,965,707 | A * | 10/1990 | Butterfield | 362/96 |
| 5,642,580 | A * | 7/1997 | Hess et al. | 40/428 |
| 6,050,011 | A * | 4/2000 | Hess et al. | 40/428 |
| 6,269,567 | B1 * | 8/2001 | MacPherson et al. | 40/428 |
| 6,944,982 | B2 * | 9/2005 | Schroeter et al. | 40/428 |
| 7,080,472 | B2 * | 7/2006 | Schroeter et al. | 40/428 |
| 7,111,421 | B2 * | 9/2006 | Corry et al. | 40/428 |
| 2002/0166554 | A1 * | 11/2002 | Berg | 126/512 |

FOREIGN PATENT DOCUMENTS

| | | | |
|---|---|---|---|
| EP | 0188892 | A1 * | 7/1986 |
| GB | 2298073 | A * | 8/1996 |

* cited by examiner

*Primary Examiner*—Joanne Silbermann

(57) ABSTRACT

A contrivance (30) simulates smoke and flames emanating from an intense burning simulated log stack fire (13). The visual effect is provided by unrestricted fluctuating light reflected off spaced apart sunburst formation bunches (41) of colored rotating metallic strips(9) of different length that transmit uneven flashes of colored light and shadow through a bronze tinted tempered glass diffusing screen(16)(39) simulating images of smoke and flames when viewed from the front, simultaneously the simulated log stack bed (13) adjacent the lower area of the screen(17)(40) is illuminated providing a glowing surface and a intense flickering flame effect is transmitted and viewed through the plurality of openings(14) in between the individual protruding angle backward log configuration of the log stack bed(13) creating the overall images of smoke and flames emanating from out of a real log stack burning fire with intense burning core simulating a natural roaring log fire.

11 Claims, 5 Drawing Sheets

SIMULATED INTENSE LOG STACK BURNING FIRE

FIELD OF INVENTION

The present invention relates generally to electric fireplaces and more particular to an improved log fire visual effect by simulating smoke and flames emanating from a stack of protruding logs that will provide the visual effect of intense burning of a real roaring log fire.

BACKGROUND OF THE INVENTION

I recognized the demand for electric fireplaces is increasing each year in North America and therefore the consumers desire for an improved simulated electric fireplace visual effect is present, I feel that the invention describe herein is novel and a major improvement to the overall visual effect of present simulated log burning fire.

The use of a full diffusing screens providing back projected flame images is well know and therefore used in over fifty US and world wide patents and publications but I will only refer herein to the closest prior art of record to my present invention that I can find after my due diligence search.

U.S. Pat. No. 4,965,707 Butterfield teaches a full back projection screen with forced air moving loosely fixed twisted vertical side by side ribbons to simulate the flames, Butterfield also teaches that using a front clear glass plate positioned in front of and in contact with the vertical back projection screen provides a reflective front surface by forming a doublet, Butterfield further teaches the front reflective surface produces a virtual image by reflection of the ember fuel bed and creates the appearance of flames emitting from in between the front simulated ember fuel bed (the object) and the virtual image of the simulated ember bed (the reflection), this optical principle tells us that the reflected image is as far behind the reflective surface as the real object is in front of the reflective surface.

U.S. Pat. No. 5,642,580 Hess et al teaches a full back projection screen with a flicker flame element that directs fluctuating light onto the back projection screen to simulate flames, Hess et al claims the application of a silver mirror reflective surface coating provides a mirrored front surface area located on the full back projection screen above the simulated ember fuel bed producing a mirror image of the simulated ember fuel bed which creates the appearance of flames emitting from in between the front simulated ember fuel bed (the object) and the virtual mirror image of the simulated ember fuel bed (the reflection), this optical principle tells us that the image in the mirror is as far behind the mirror surface as the real object is in front of the mirror surface.

U.S. Pat. No. 7,111,421 Corry. Our patented invention did not teach a back projection system but claimed a vertical window partition positioned in front of a simulated silk flame sheet, the flame sheet is moved in a flame like manner above the simulated ember fuel bed by upward forced air provided by a blower, the simulated ember fuel bed in which our claim 4 claims at least one window log forms part of the ember fuel bed and is positioned adjacent the partition immediately in front of the diffusing area of the window partition, the upper area of the window partition above the extended moving flame sheet is a clear transparent viewing area allowing an observer to see through the firebox onto the back wall producing a three dimensional silk flame sheet.

My present invention provides the consumer with a novel improvement by simulating an intense log stack burning cabinet design electric fireplace log set that fits into existing fireplace without any form of construction work and can be removed by hand in the winter months if the consumer desires to use a real log or fuel fire by using a bronze tinted tempered glass diffusing screen above the flame forward simulated log stack fire bed, the transmitted colored fluctuating light provides simulating smoke and flame images that appear to be emanating out of the simulated log stack combined with the transmission of the reflected colored fluctuating light visible through the plurality of openings in between the protruding individual log configurations which produce a stunning overall visual effect of an intense burning real log fire.

SUMMARY OF THE INVENTION

In a broad aspect of the present invention, I provide a simulated electric log set burning fire which provides colored fluctuating simulated smoke and flames that appear to emanate out of the simulated protruding log stack fire bed which is designed with a plurality of opening in between the individual logs within the log stack that produces the visual effect simulating the intense inner burning core of a real log fire.

My present invention fulfils the need for an improved electric simulated log set fire visual effect when placed inside a regular vented or un vented fire place opening.

The above and other objects, and advantages of my present invention become even more readily apparent to those skilled in the art upon reading of the following detailed description in conjunction with the drawings wherein there is shown and described illustrative embodiments of the invention.

BRIEF DESCRIPTION OF THE DRAWINGS

For better understandings of the present invention, and to show how it may be carried into effect, reference will now be made, by way of example to accompanying drawings and the terminology used in the reference to the numbered components in the drawing is as follows.

1. The Contrivance.
3. Bottom wall.
4. Side wall.
6. Back wall
9. Colored sun burst compiled reflective strips.
10. Rotating electric motor
11. Rotating shaft.
12. Bulb.
19. Cabinet metal fixing clip and two screws.
20. Electronic receiver.
21. Main power switch
22. Electric blower heater.
23. Heater switch.
24. Mains cable and plug.
25. Light intensity switch
26. Two on/off red warning lights.

28. Heater outlet.
33. Air vents.
34. Heater opening.
35. Ember bed outer surface.
39. Bronze tinted tempered glass cabinet diffusing screen.
40. Lower tinted tempered glass cabinet screen area.
41. Sunburst shaped metallic colored strips.
42. Rubber holding sleeve for tinted tempered glass screen.
43. Simulated flame images.
44. Flicker flame element assembly.
46. Matt black inside back wall.
47. Matt black inside side walls.
48. Matt black inside top wall.
49. Cabinet tempered tinted glass screen metal clip and two screws.

The drawings show the preferred embodiment of the present invention.

Figure 3:
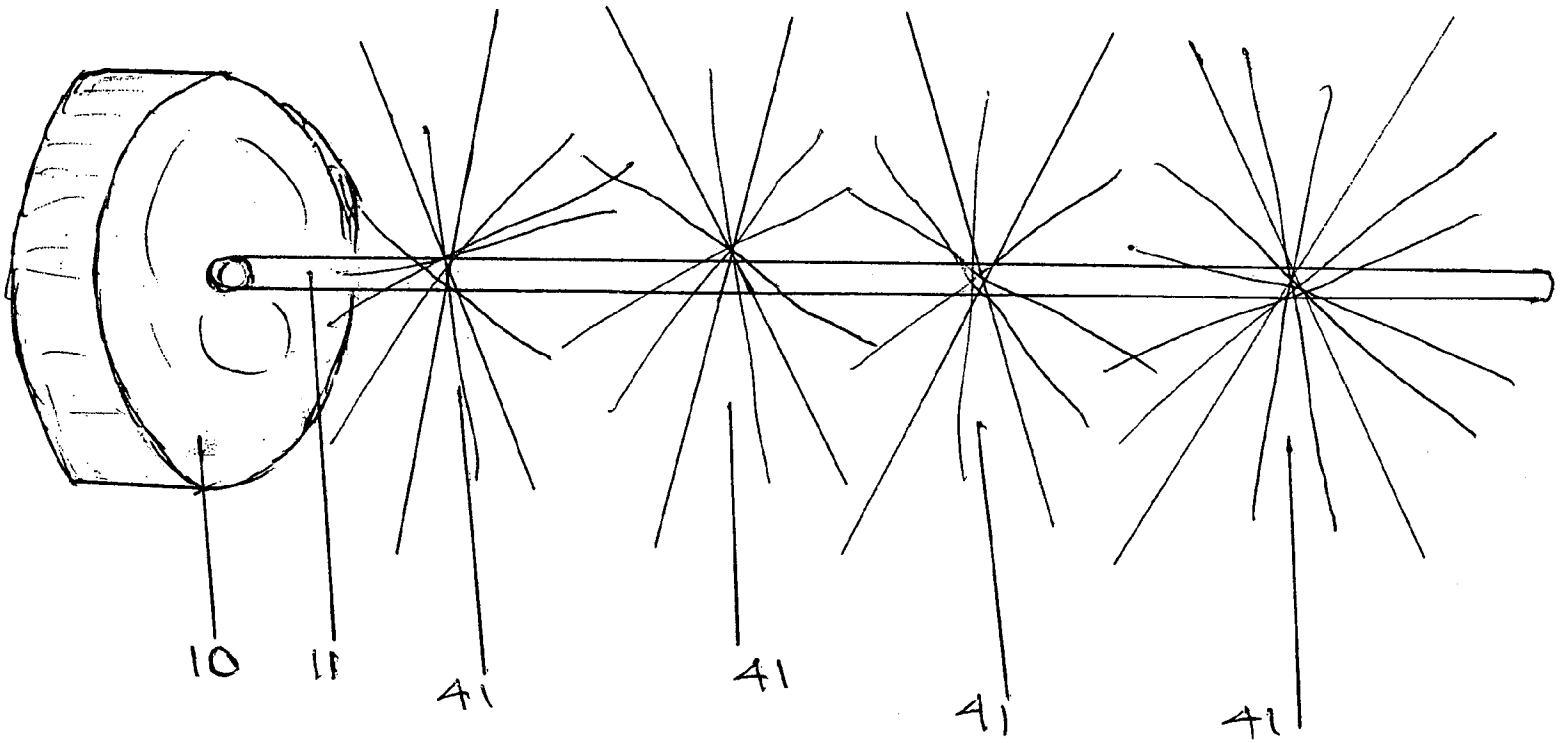
FIG. 3 is a side view of the flicker flame.

The simulated log stack burning fireplace contrivance of the present invention is illustrated in the free standing cabinet basket illustrated drawings FIG. 3: 5: 6: 7: 8: 9: 10.

FIG. 3 is a side view of the flicker flame.

Figure 6:
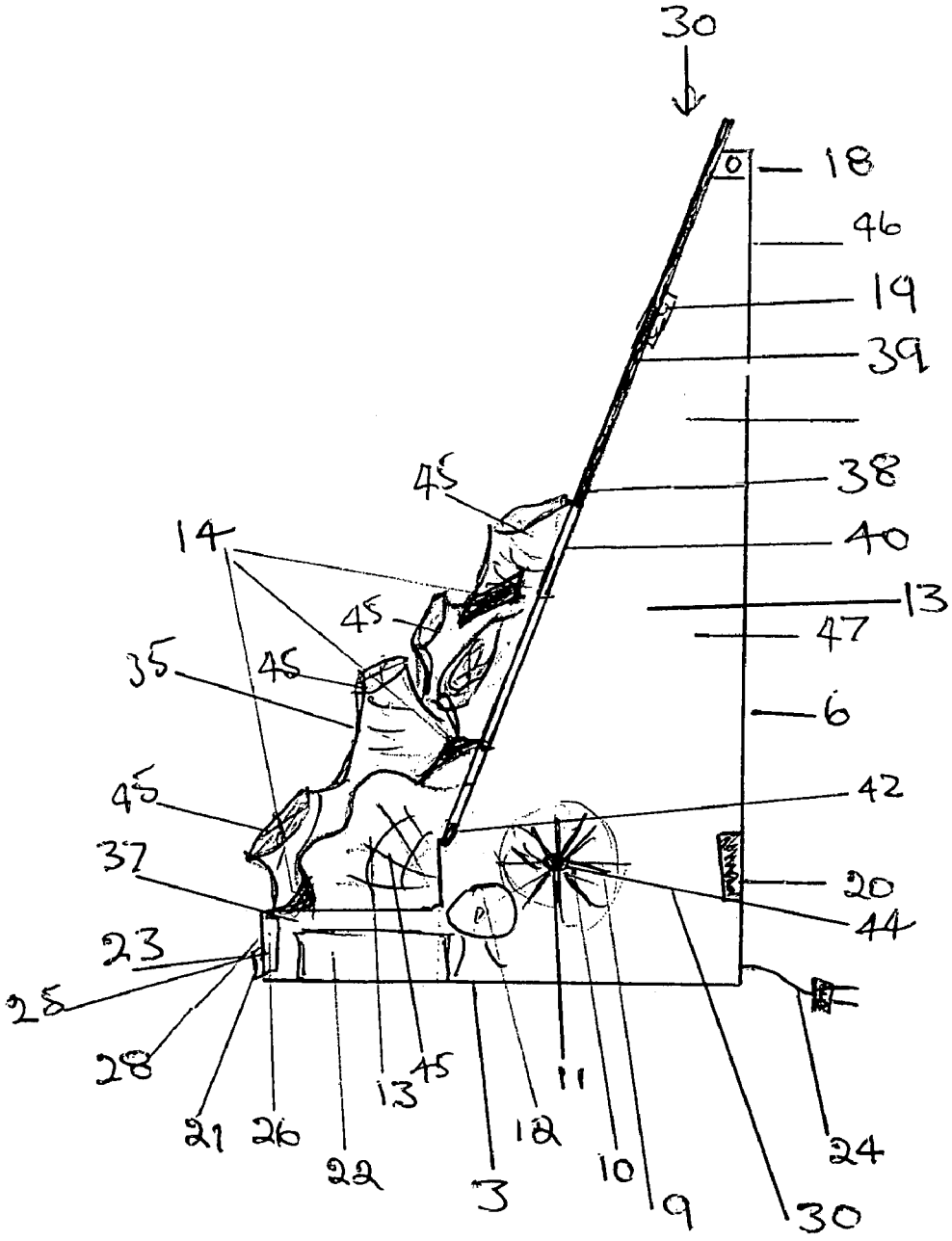
FIG. 6 is a side view of the free standing cabinet.

FIG. 6 is a side view of the free standing cabinet housing.

Figure 7:
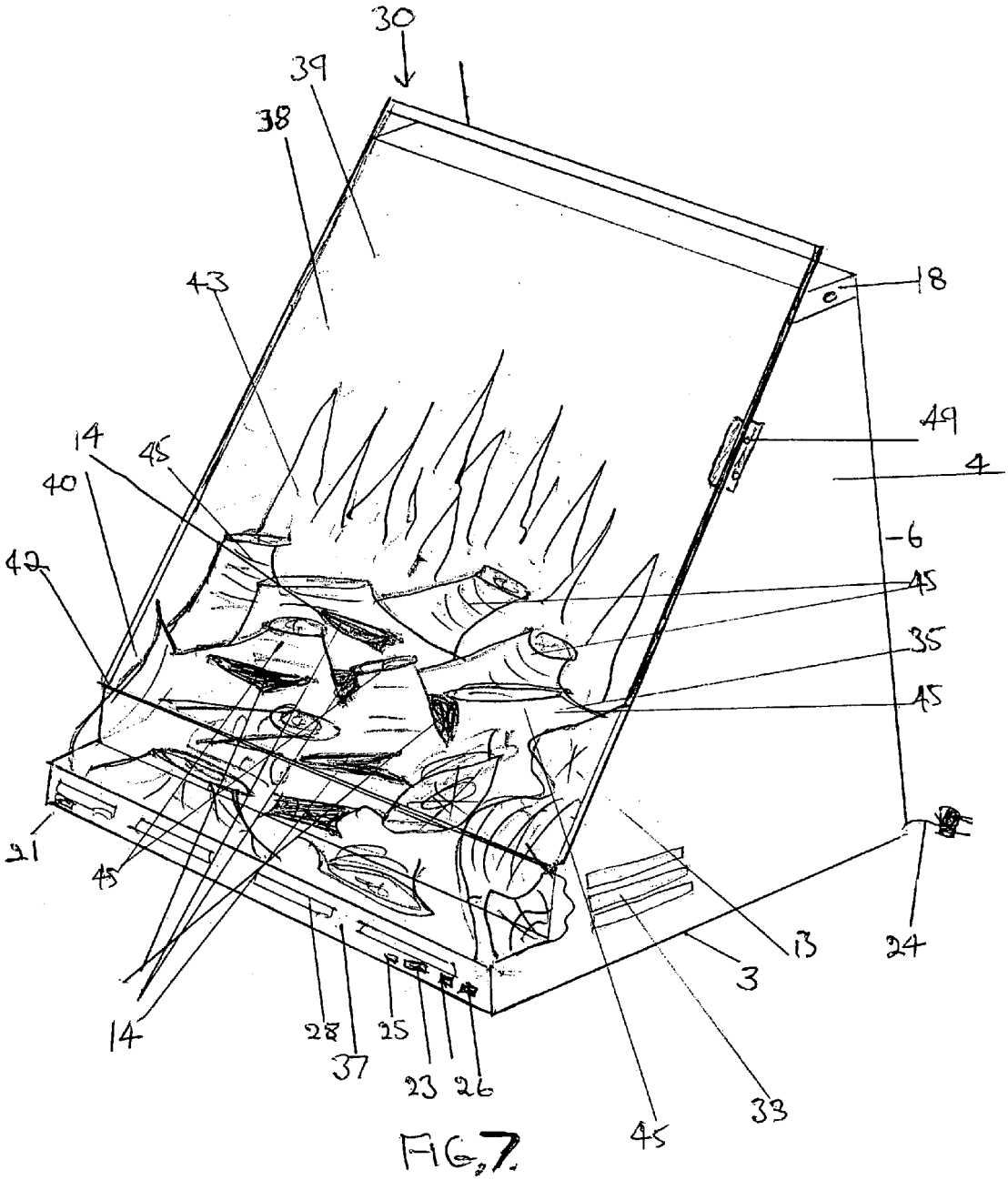
FIG. 7 is a front off set view of the cabinet housing.

FIG. 7 is a front off set view of cabinet housing.

Figure 8:
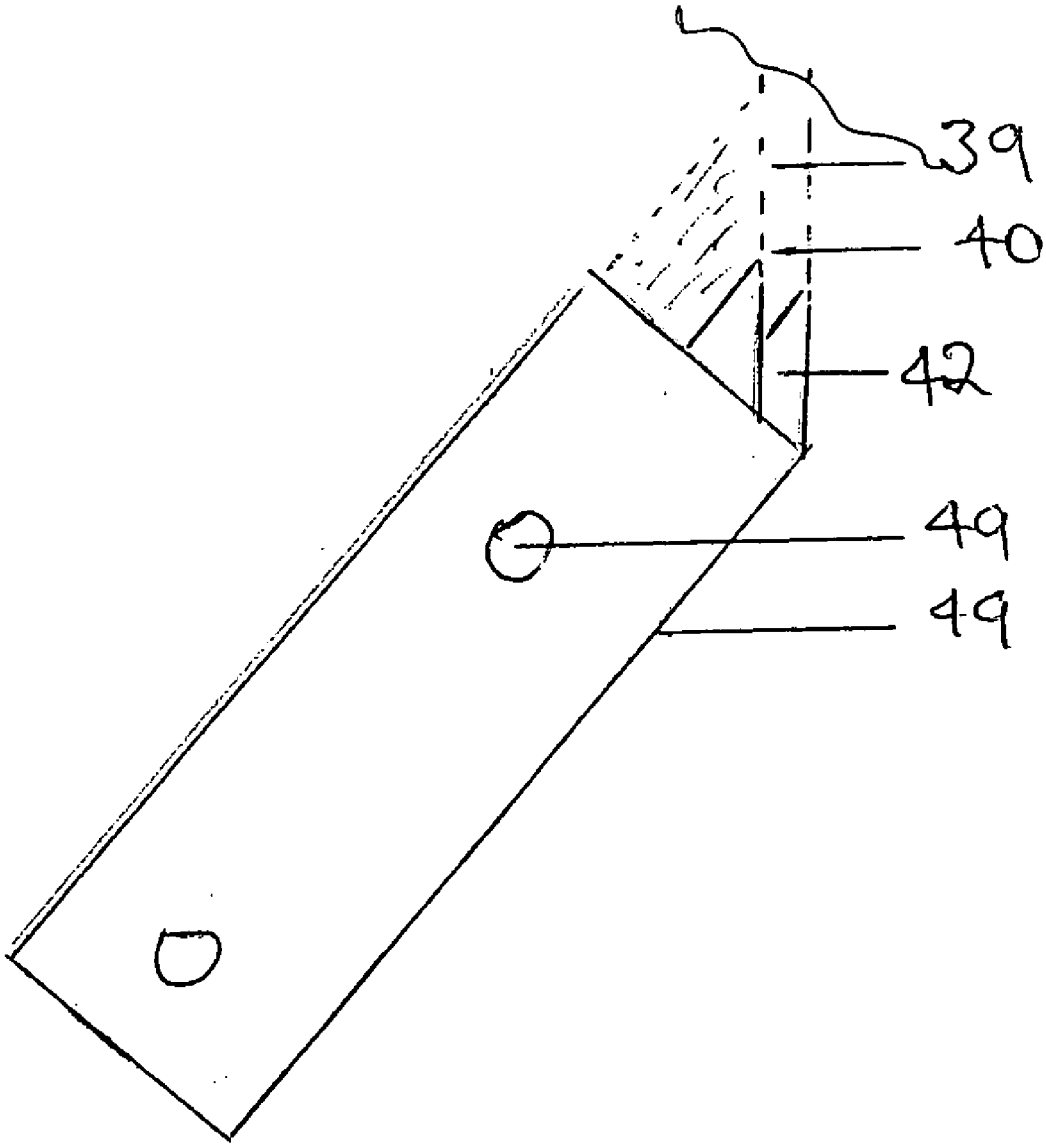
FIG. 8 is an off set view of the cabinet screen metal clip.

FIG. 8 is an off set view of the cabinet screen metal clip.

Figure 9:
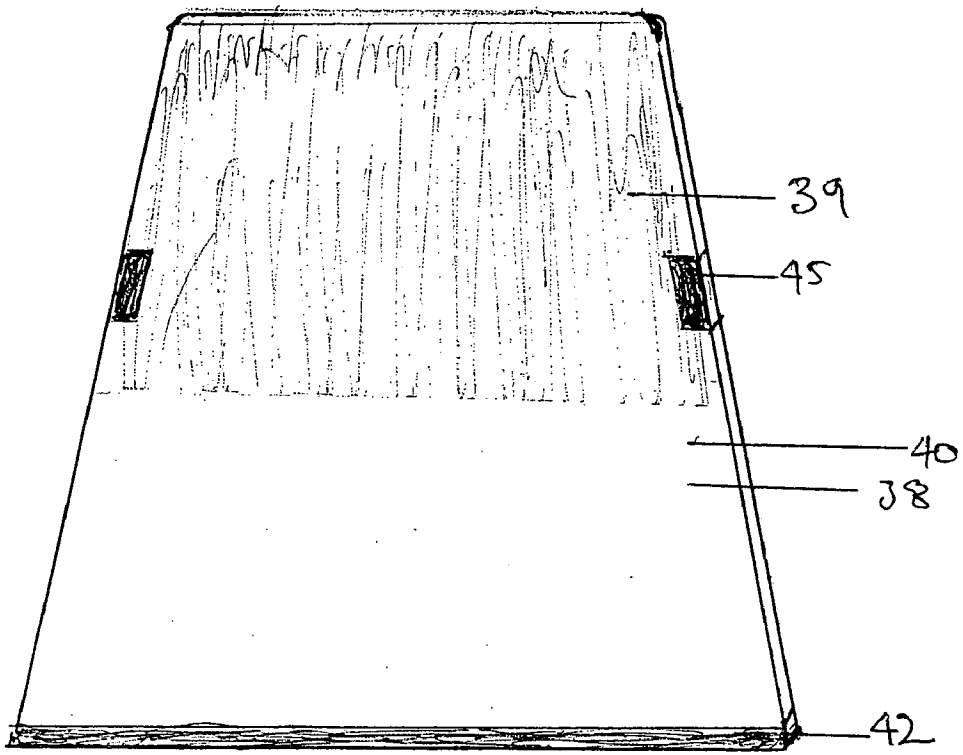
FIG. 9 is a front view of the cabinet housing bronze tempered glass screen.

FIG. 9 is a front view of the cabinet housing bronze tempered glass screen.

Figure 10:
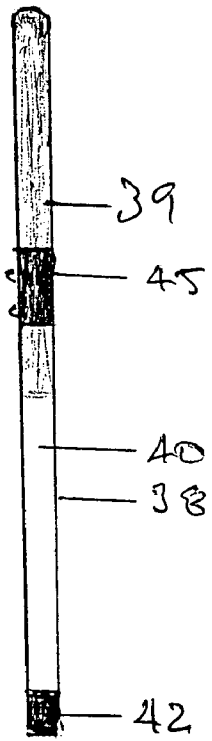
FIG. 10 is a side view of the cabinet housing bonze tempered glass screen.

FIG. 10 is a side view of the cabinet housing bronze tempered glass screen.

DETAILED DESCRIPTION OF THE PREFERRED EMBODIMENT

The pith and marrow of my invention relies on the novel visual effect created by the new invention herein described and provided by the bronze tinted tempered glass screen(15) (38) the new design of a flame forward simulated log stack fire bed(13) having a plurality of openings(14) in between the protruding individual logs configuration of the simulated log stack fire bed(13), the different lengths of the individual metallic colored strips that compile the sun burst shaped flicker flame element assembly, the absence of any form of light restricting or interfering shutter or reflector positioned between the light source and the diffusing screen allowing some of the reflected colored light rays to be scattered in all directions behind the diffusing screen producing shadows on the matt black painted inner walls whilst scattering other colored light rays that produce flashes of uneven length light streams that are transmitted through the diffusing screen.

The bronze tinted tempered glass screen (16) provide the neutral filter reducing room light by alleviating the reduction caused by room light when no filter is present. The application of a bronze tint on the upper diffusing area(16) of the tempered glass screen(15) reduces reduction of the contrast of the projected flame images caused by room light and creates a visual image transmitted through the diffusing area of the bronze tinted tempered glass screen (16) of flames and smoke.

The free standing cabinet(30) housing model requires no doors(5), or draw curtains(the angled backwards bronze tinted tempered glass screen forms the front of the cabinet housing and provides an upper diffusing screen (39) visible to an observer, and an out of sight lower window screen area (40) is hidden behind the simulated log stack bed.

The bronze tinted tempered glass diffusing area (6) (39) is visible to an observer and covers the upper area above the flame forward simulated log stack fire bed (13) which transmits the reflected colored fluctuating light creating upward and sideways moving smoke images and incandescent simulates flame images on the front surface of the diffusing area(16) (39) of the screen(15) (38) when viewed from the front of the housing, at the same time the colored reflected fluctuating light is transmitted through the window (17) (40) area of the screen(15) (38) not visible to an observer behind the flame forward simulated log fire bed (13) which illuminates the outer surface(35) of the translucent simulated log stack fire bed (13) and simultaneously provides maximum transmission of the reflected colored fluctuating light through the plurality of openings(14) in between the protruding individual log configuration of the log stack fire bed (13) simulating the intense inner burning core (14) produced by a real roaring log fire and creating an overall improved visual appearance of smoke and flames emanating out of the flame forward protruding log stack(13).

Air vents(33) are located on each side of the cabinet housings(30)(31).

The free standing cabinet (30) is a portable complete decorative fire cabinet (30) housing that will fit instantly in or out of a regular fireplace opening for the summer period or against a wall providing a simulated log stack fire display when a real fuel burning or gas fire is not required or possible.

An electric blower heater(22)(23) is provided to further simulate a real fire and will provide background heating, the heater unit is fitted on a top shelf(36) in the firebox(31) housing and on the bottom shelf(37) in the free standing basket cabinet (30).

To further simulate the mood of a real log burning fire a brightness control(25) is available which allow the observer to select the desired intensity of the simulated log stack burning log fire's overall visual effect.

A electronic receiver(20) is fitted inside at the back of the housings(30) (31) and a manual main power witch(21) and two on/off and blinking red warning lights(26) are located on the front of the housings (31) (32) a remote hand held control is provided.

The light source is provided by at least two of at least 40 watt power clear bulbs(12) which are held horizontal below the simulated log stack fire bed (13) slightly forward of the screen(15)(38).

The fluctuating light reflecting flame element assembly consists of an electric driven rotating motor(10) a horizontal drive shaft (11) fitted with spaced apart sunburst shape bunches of different length metallic colored strips(41) and is positioned behind the light source(12) and the screen(15) (38).

It is to be understood that whilst I have described the preferred embodiment of my invention other modifications or improvements may be made without departing from the spirit and scope of the invention. We have defined the scope of the invention in the claims appended hereto.

I claim:

1. A contrivance for simulating smoke and flames emanating from out of an intense burning log stack housed in a firebox comprising:

a light source;

a colored flicker flame element assembly;

a electronic receiver board;

a bronze tinted, tempered glass diffusing screen, angled backwards; and a freestanding metal housing cabinet;

wherein the diffusing screen is visible to an observer whereupon transmitted fluctuating colored light provides incandescent flashes of light and shadows producing upwards and outward moving images that simulate smoke and flames; and wherein the diffusing screen comprises a lower window area, specifically behind a flame forward simulated translucent log stack fire bed, which is not visible to an observer; and the simulated translucent log stack fire bed positioned against the diffusing screen in front of the window area receiving colored reflected fluctuating light, whereupon the outer surface area of the log stack fire bed is illuminated together with intense transmission through a plurality of openings in between individual protruding log configurations of the log stack bed creating the image of smoke and flames from out of a real log stack fire with an intense burning core simulating a natural roaring fire.

2. A contrivance as claimed in claim 1, wherein the flicker flame element assembly is situated inside the cabinet which includes a top cover, two side walls angled backwards and upwards, a high back wall, and a bottom wall, the inside surfaces of the side, back and bottom walls behind the diffusing screen being matte black; and an electronic blower heater on the bottom wall not visible to an observer; and a brightness intensity control for the light source.

3. A contrivance as claimed in claim 2, wherein the brightness of the colored light and log stack fire bed are controlled by the brightness intensity control which can be operated by a manual switch or a hand held remote.

4. A contrivance as claimed in claim 3, wherein a preprogrammed receiver is fitted inside at the back of the cabinet for the remote control.

5. A contrivance as claimed in claim 2, wherein no light interfering or restricting shutter forms any part of the flicker flame element assembly, and therefore the colored light is allowed to scatter causing peripheral shadows on the inside matte black walls of the cabinet.

6. A contrivance as claimed in claim 2, wherein the back wall and side walls form a top opening behind the diffusing screen and the cap cover is secured by two screws.

7. A contrivance as claimed in claim 1, wherein the flicker flame element assembly includes rotating sun burst bunches of different length colored metallic strips made of or coated with at least one reflective color.

8. A contrivance as claimed in claim 7, wherein the reflective colored metallic strips are complied in sun burst bunches of different lengths and are fixed spaced apart on a rotating drive shaft and are driven by an electric motor which scatters uneven length flashes of light and shadows that are transmitted through the diffusing screen to create the visual appearance of smoke and flames.

9. A contrivance as claimed in claim 7, wherein the reflective colored fluctuating light is simultaneously scattered inside the cabinet, through the diffusing screen, through the translucent log stack fire bed, and through the plurality of openings in between the individual log configurations.

10. A contrivance as claimed in claim 1, wherein the log stack fire bed is formed of a translucent plastic or translucent resin.

11. A contrivance as claimed in claim 1, wherein the brightness of the flames and log stack fire bed is adjustable by an intensity control which can be operated by a manual switch or a remote control.

* * * * *